United States Patent [19]

Krautz

[11] 4,381,717

[45] May 3, 1983

[54] SECTIONAL SMOKESTACK

[76] Inventor: Alfons O. Krautz, 57 N. Country Rd., Shoreham, N.Y. 11786

[21] Appl. No.: 156,560

[22] Filed: Jun. 5, 1980

[51] Int. Cl.[3] ..... F23J 11/00

[52] U.S. Cl. ..... 110/184; 52/249; 98/58

[58] Field of Search ..... 110/184; 98/58, 59, 98/60; 52/249

[56] References Cited

U.S. PATENT DOCUMENTS

| | | | |
|---|---|---|---|
| 2,219,281 | 10/1940 | Granstrom | 110/184 X |
| 3,749,132 | 7/1973 | Prezewalski | 98/60 X |
| 3,822,636 | 7/1974 | Chadwick | 98/60 |
| 3,872,780 | 3/1975 | Zanias | 98/60 |
| 4,104,868 | 8/1978 | Jackson | 52/743 |
| 4,111,107 | 9/1978 | Engleke | 110/184 X |
| 4,111,327 | 9/1978 | Janakiev | 52/249 |
| 4,216,709 | 8/1980 | Bottenbruch | 110/184 X |

*Primary Examiner*—Edward G. Favors

*Attorney, Agent, or Firm*—Richard C. Conover

[57] ABSTRACT

A dual wall concrete smokestack having a freestanding flue liner in each flue. The smokestack being constructed of preassembled and precast concrete sections axially stacked one upon the other. The preassembled sections have a precast concrete body having a flue aperture. An inner flue liner is carried within the flue aperture spaced inwardly and concentrically from the wall of the flue aperture. The wall of the flue aperture further having a flue liner stop means. The inner flue liner having a bracket for engaging the flue liner stop means to prevent the flue liner from dropping downwardly and out of the concrete body when being transported to the site of construction. The concrete body further having another aperture to be aligned with a corresponding aperture of an adjacent section for receiving reinforcing rods extending from the bottom of the smokestack to the top of the smokestack and for receiving poured concrete as the smokestack is being erected to tie the sections together.

5 Claims, 9 Drawing Figures

SECTIONAL SMOKESTACK

BACKGROUND OF INVENTION

This invention relates to a precast concrete, dual wall smokestack constructed by stacking preassembled sections one upon the other.

Dual wall smokestacks have, in recent years, been widely used because the outer wall can be constructed of different material than the inner wall. Thus, the inner wall may be constructed of material best suited for transporting hot gases and the outer wall can be constructed of material best suited to support the stack both statically and dynamically. Furthermore, the gap between the inner wall and the outer wall may be filled with insulation to insulate the inner wall from the outer wall or the gap may be left as an air space which also provides insulation. This enables the inner stack temperature to be maintained during operation at a high temperature relative to the outer shell. This high temperature tends to reduce buildup of detrimental material on the inner surface of the inner wall and at the same time aids in the plume rise.

Dual wall smokestacks commonly have been constructed of steel. For example, a dual wall smokestack constructed of sections stacked one upon the other is described in U.S. Pat. No. 3,302,599. Each section of this smokestack has the air space between the inner and outer walls hermetically sealed. A non-sectionalized dual wall steel smokestack having freestanding inner and outer walls is described in U.S. Pat. No. 3,537,411. However, because of the high cost of steel in recent years, attention has been drawn to concrete stacks which in some instances are less expensive to build. Further, concrete stacks have asthetic possibilities which were not feasible with steel stacks.

Concrete stacks, because of their inherent weight, are generally constructed at the job site either by pouring the concrete stack directly or by constructing the stack with precast concrete sections.

U.S. Pat. No. 4,104,868 describes one such sectionalized precast concrete stack. This patent describes a method of constructing a chimney by stacking interfitting segments vertically to form an inner liner and then constructing an outer wall spaced from the inner lining by stacking interfitting segments vertically and in surrounding relation to the inner liner. The stack is built in sections. Reinforcing steel bars are placed in the interstitial gap between the inner liner and the outer wall during construction of the stack and concrete is poured in situ into the gap to cement the adjacent segments together. The inner wall in this smokestack is cemented to the outer wall.

West German Patentschrift No. 21 00 429 is also describes a concrete stack to be constructed in sections. This patent discloses preassembled sections to be taken to the job site having both an inner liner and an outer wall. During construction, the sections are placed one on top the other and morter placed between the sections to cement adjacent sections together. The sections are each carried to the job site in the preassembled state with a spreader bar having bolts threaded into threaded sleeves embedded in the inner liner and the outer wall. At the construction site, the bolts are loosened to permit relative displacement of the inner liner with the outer wall so that in the finally constructed stack, the joints between the inner liner sections and the outer wall so that in the finally constructed stack, the joints between the inner liner sections and the outer wall sections are staggered.

SUMMARY OF THE INVENTION

The present invention overcomes the disadvantages of prior precast sectionalized smokestacks by providing preassembled sections which may be easily transported to the job site and which may be easily placed one upon the other to erect the stack without the necessity of manually adjusting the relative positions of the inner wall and the outer wall during erection and yet provides a dual wall smokestack where the inner lining and outer wall are each freestanding so that the full benefits of the dual wall stack may be realized. The sections are tied together with reinforcing bars inserted in apertures in each section, aligned during erection, and concrete is poured into the apertures to cement the reinforcing bars in place thereby tying together the sections of the smokestack from the bottom to the top of the smokestack.

The dual wall smokestack according to the present invention is constructed of precast, preassembled, concrete sections which are axially stacked one upon the other to build the smokestack. Each precast, preassembled, concrete section has a precast concrete body having a flue aperture in which an inner flue liner is carried. The inner flue liner is axially movable with respect to the concrete body and has a bracket for engaging a flue liner stop fastened to the wall of the flue aperture of the concrete body. The bracket in cooperation with the flue liner stop prevents the flue liner from dropping downwardly and out of the concrete body when the section is being transported.

Threaded sleeves are embedded in the concrete body in which are inserted lifting devices such as eye bolts. With this construction, each section may be carried to the job site in preassembled condition. When the section is properly in place, the lifting devices are removed so that another section may be placed on top.

Each section further includes an aperture through the concrete body through which reinforcing rods are threaded during erection of the smokestack. The reinforcing rods are taken to the job site in sections and welded or tied together during erection. Suficient lengths of the reinforcing rods are welded or tied together during erection so that the reinforcing rods in place extend at least through the length of the next placed precast section. Morter is placed on the concrete body of the section in place, the next section is threaded on the reinforcing rods and positioned on top the section in place. Concrete is then poured into the apertures in which the reinforcing rods are located to tie the sections together.

The smokestack is erected on a foundation in which are embedded the reinforcing rods to be threaded through the apertures in the first section. This first section includes a flue liner which extends above the top of the concrete body. When the second section is placed on the first section, the inner flue is raised upwardly relative to the outer concrete body. With this construction, the joints between the inner liners of adjacent sections are offset from the joints between the concrete bodies of the adjacent sections. This is accomplished automatically without the necessity of manually adjusting the relative positions of the inner flue liner and the concrete body during erection.

BRIEF DESCRIPTION OF THE DRAWINGS

In order that the invention may be clearly understood and readily carried into effect, a preferred embodiment will now be described, by way of example only, with reference to the accompanying drawings wherein.

DESCRIPTION OF A PREFERRED EMBODIMENT

Figure 1:
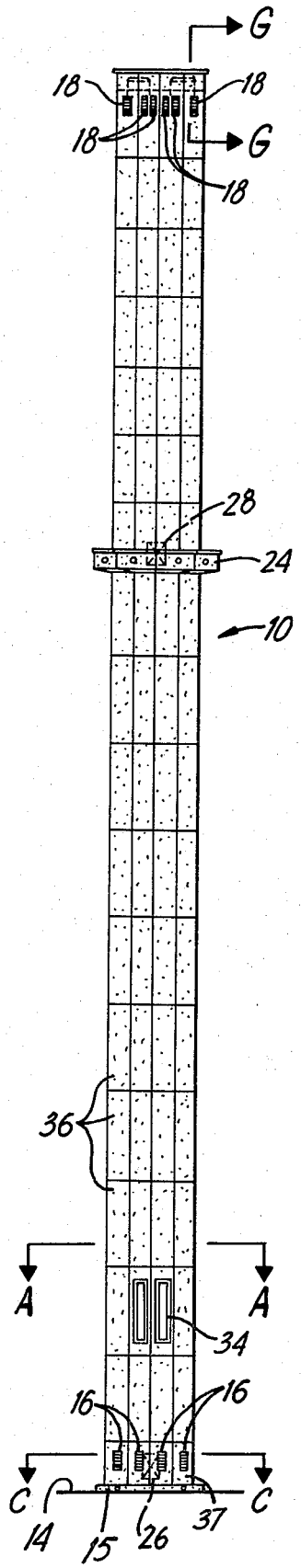
FIG. 1 is an elevational view of a sectional smokestack constructed according to the present invention.

A precast dual wall sectionalized concrete stack 10 is shown in FIG. 1. The smokestack shown here is a two flue smokestack as shown in the cross-sectional view in FIG. 2. The number of flues is not critical to the practice of the invention and depends on the particular application.

Figure 2:
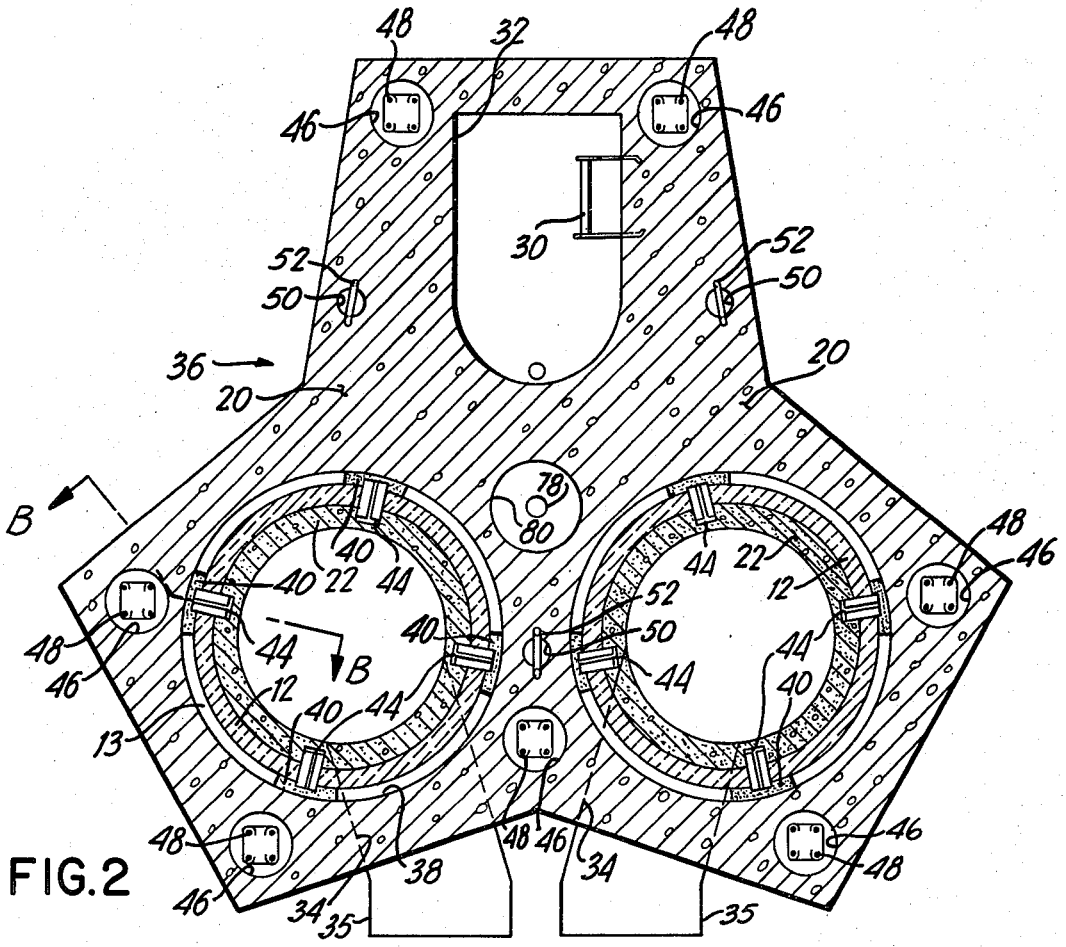
FIG. 2 is a cross-sectional view of a smokestack section along line A—A in FIG. 1 with the base and foundation omitted.

The smokestack rests on a foundation 14. Breeching inlets 34, as shown in FIGS. 1 and 2, are connected to breeching 35 which directs hot gases and smoke from an incinerator or furnace, for example, to the flues of the smokestack 10.

Figure 3:
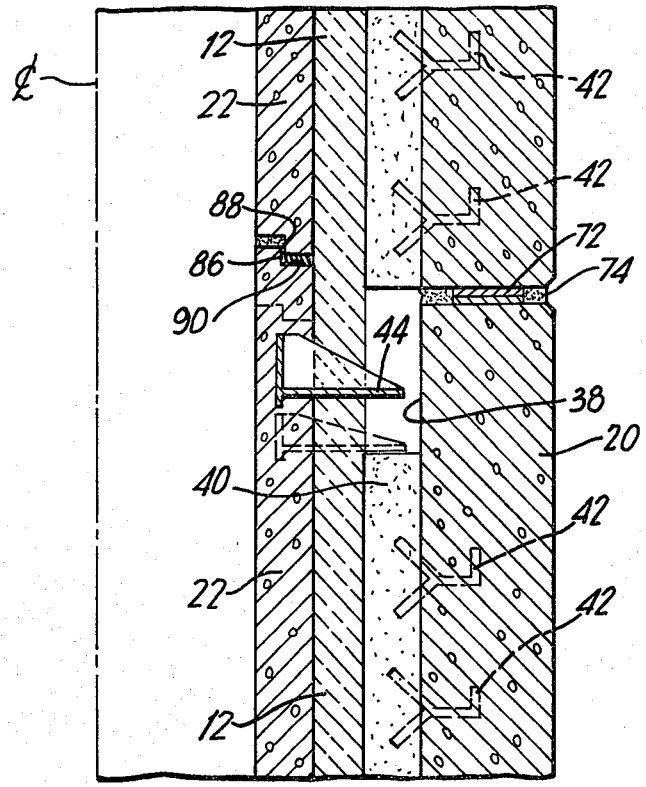
FIG. 3 is an elevational sectional view along line B—B in FIG. 2 but including a portion of adjacent sections showing the joint between sections.

The smokestack 10 is constructed of precast, preassembled sections 36. In a smokestack recently designed, the dimension of the sections were chosen to be approximately 4 feet in height and 12 feet across. (FIG. 1 shows sections 36 for purposes of illustration but the size of each section is not drawn to scale). A cross-section of one of these sections is shown in FIG. 2. Each section is formed of a precast concrete body 20 which forms an outer wall of the smokestack flue. The concrete body 20 has a flue aperture 38 within which an inner flue liner 22 is positioned in a concentrically spaced relation. An inner liner support 40 which may be, for example, a concrete block is fastened to the inner wall of flue aperture 38 with anchors 42 as shown in FIG. 3. If multiple inner liner supports 40 are used, they are spaced preferably equidistantly around the circumference of the aperture 38, as shown in FIG. 2.

The inner liner 22 may be constructed, for example, of acid brick, precast refractory or steel. In the drawings shown here, the liner 22 is constructed of precast refractory for purposes of illustration. A bracket 44 is mounted to or embedded in the inner liner 22 and extends radially outwardly from the outer surface of the inner liner 22 as shown in FIG. 3. This bracket 44 spans the space between the inner liner 22 and the concrete body 20 and when the section is being transported, as when being transported to a job site, rests on the inner liner support or stop 40 as shown in phantom in FIG. 3 to prevent the inner liner 22 from dropping downwardly and out of the concrete body 20.

Figure 5:
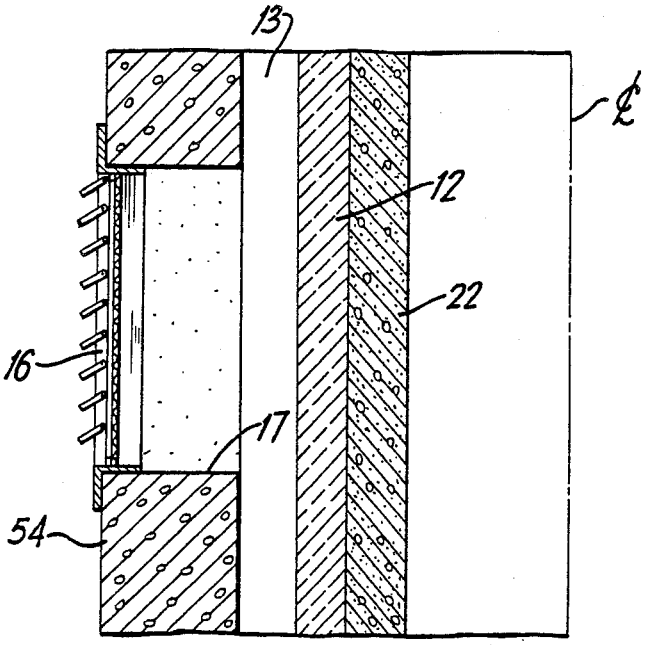
FIG. 5 is an elevational sectional view along line D—D in FIG. 4 omitting the base and foundation.

In a preferred embodiment, insulation 12 is inserted around the inner liner 22 in the space between the inner flue liner 22 and the wall of aperture 38 of concrete body 20. As an alternate embodiment, the space could be left empty leaving an air space which also has insulating properties. This insulation insulates the inner flue liner 22 from the concrete body 20 and reduces heat dissipation from the inner flue liner 22 during operation of the smokestack. Thus, the flue temperature during operation of the smokestack is maintained at a higher level than would be the case absent insulation or an air space. The inner liner supports or stops 40 hold the insulation against the flue liner 22. Air gaps 13 are formed in the space bounded by stops 40 and the concrete body 20 and insulation 12 as shown in FIG. 2. Bottom louvers 16, as shown in FIGS. 1 and 5, cover the outside openings of passageways 17 which provide fluid communication between these air gaps 13 and the outside air at the bottom of smokestack 10. Top louvers 18 and corresponding passageways (not shown) provide a similar function at the top of the stack as shown in FIG. 1. The air gaps 13 also insulate the inner flue liner 22 from the concrete body 20.

The concrete body 20 of each section 36 further includes apertures 46 extending through each section parallel to the longitudinal axis of the flue aperture 38. These apertures 46 receive reinforcing rods 48 which, when the stack is finally erected, run from the bottom to the top of the stack. During erection of the stack, the apertuers 46 are threaded on to the reinforcing rods 48 extending upwardly from the section 36 already in place. Concrete is then poured into apertures 46 so that when this concrete hardens the sections are tied together. The reinforcing rods 48 are preferably brought to the job site in sections. During erection, the reinforcing rods 48 are welded or tied together. The next section or sections are then threaded over the reinforcing rods. To minimize threading difficulties, sections of the reinforcing rods are welded together as the smokestack is erected and sections put in place rather than all at one time.

Figure 4:
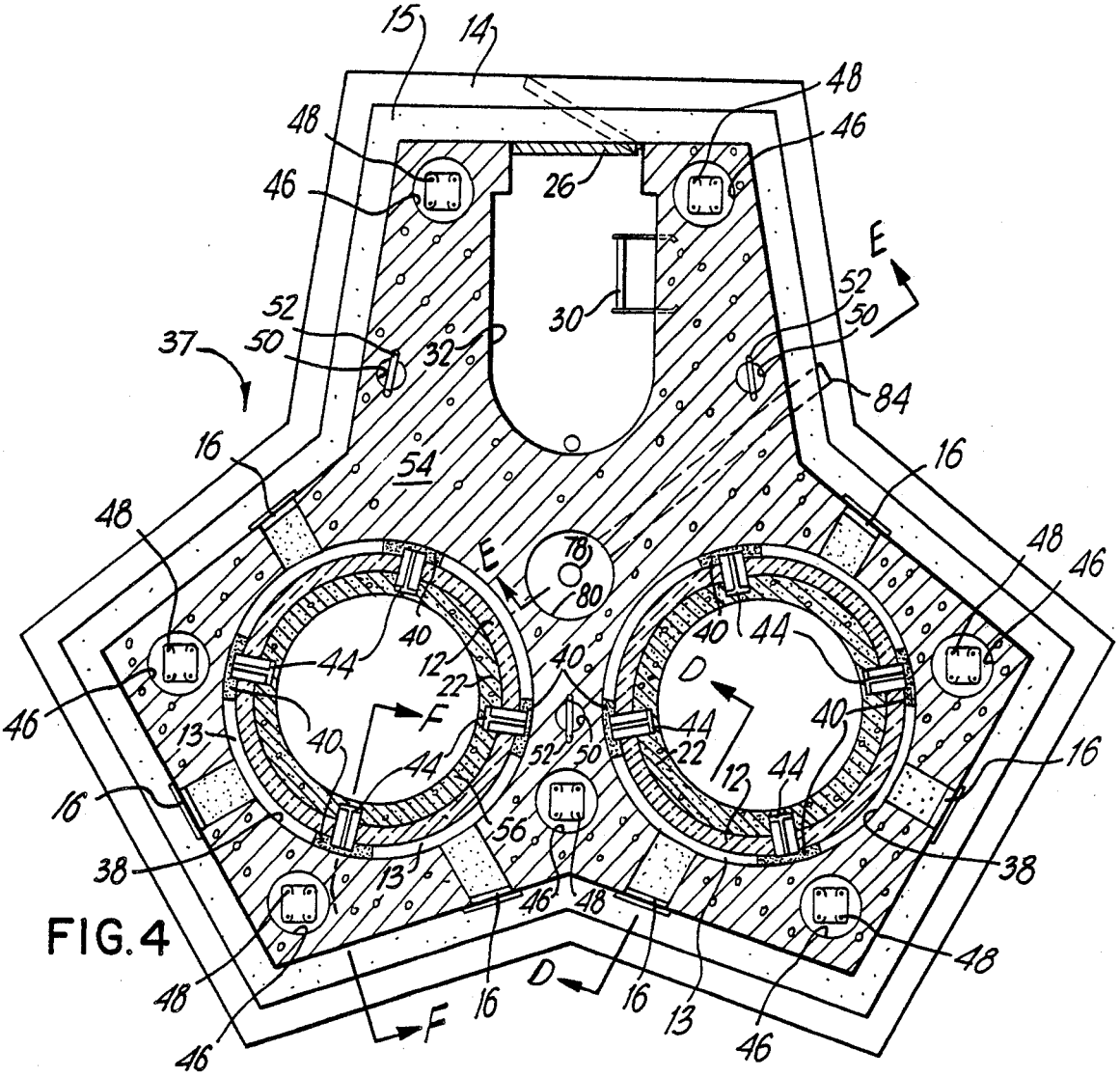
FIG. 4 is a cross-sectional view of the first section of the smokestack along line C—C in FIG. 1 and showing the base and foundation.

The smokestack 10 may include a platform 24 as shown in FIG. 1 which is accessed by bottom access door 26 as shown in FIGS. 1 and 4. The access door 26 is movable from a closed position (shown in solid) to an open position (shown in phantom) and provides entrance to a ladder passage 32 which is formed by corresponding apertures in each section as shown in FIGS. 2 and 4. A ladder 30 is placed in the passage 32. A top access door 28 shown in phantom in FIG. 1 provides an exit to platform 24 from passage 32.

Threaded sleeves 50 are embedded in the concrete body 20 as shown in FIG. 2. Threaded lifting devices 52, such as eye bolts, are threaded into threaded sleeves 50 to provide structure for lifting the sections 36 for transportation to the job site and for lifting the sections 36 to their respective positions on the stack when the stack is being constructed.

Figure 7:
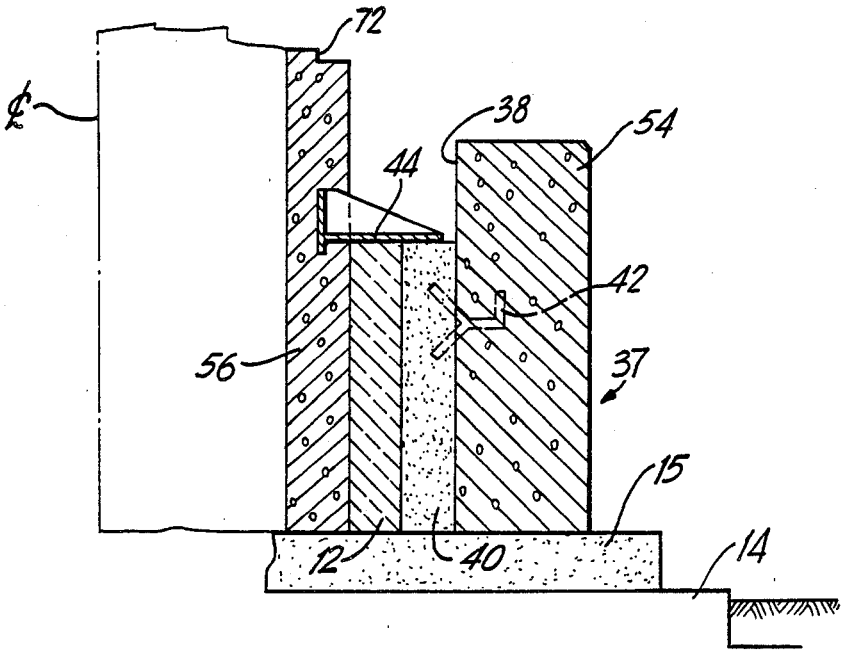
FIG. 7 is an elevational sectional view along line F—F in FIG. 4.

A cross-sectional view of the first section 37 of the smokestack 10 is shown in FIG. 4. First section 37 rests on a base 15 which in turn rests on foundation 14, as shown in FIGS. 1 and 4. The first section 37 is similar in construction to section 36 and includes a precast concrete body 54 having a flue aperture 38 in which is positioned an inner flue liner 56, as shown in FIGS. 4 and 7. The concrete body 54 further includes an inner liner support 40 anchored to the concrete body 54 with anchors 42, as shown in FIG. 7. A bracket 44 is mounted to or embedded in flue liner 56 and rests against the inner liner support 40 when this section 12 is being transported to the job site to enable the erector to move this precast preassembled piece as one unit. Insulation 12 is provided in the space between the flue liner 56 and concrete body 54 as with section 36 as shown in FIG. 7. A difference of the first section 37 with the other sections 36 is that the flue liner 56 is constructed to extend above the top surface of the concrete body 54, as shown in FIG. 7. In a smokestack recently designed, the inner flue liner 56 would extend approximately six inches above the concrete body 54.

With a first section of this construction, the inner liners 22 of sections 36 are moved upwardly with respect to the outer wall 20 of each section when they are placed one upon the other. The inner liner 22 as it is being transported is shown in phantom in FIG. 3. The solid lines in FIG. 3 show the inner liner 22 after it has been placed on a section already in place. This staggering of the joints between the inner liners of adjacent sections and the outer walls of adjacent sections and as shown in FIG. 3 is accomplished without the necessity of using screws or other means. The stack may be erected quickly without the necessity of manually staggering these joints.

Figure 6:
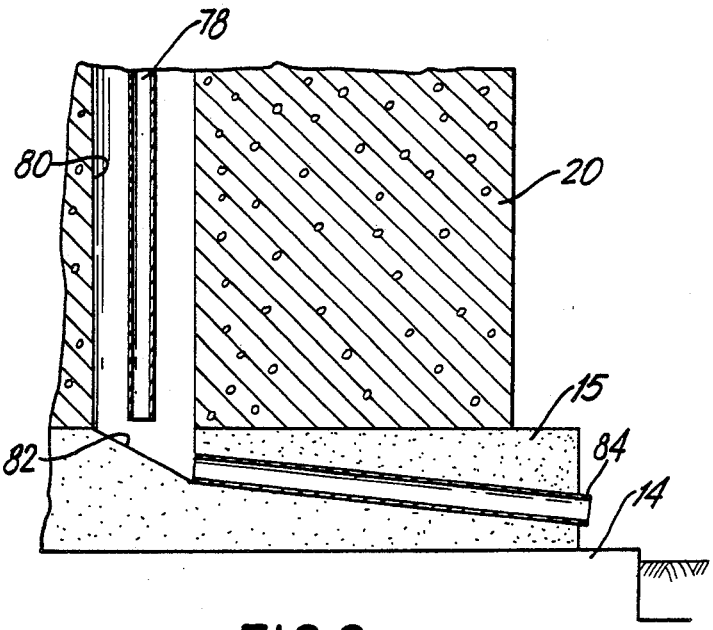
FIG. 6 is an elevational sectional view along line E—E in FIG. 4 showing the base and foundation.
Figure 8:
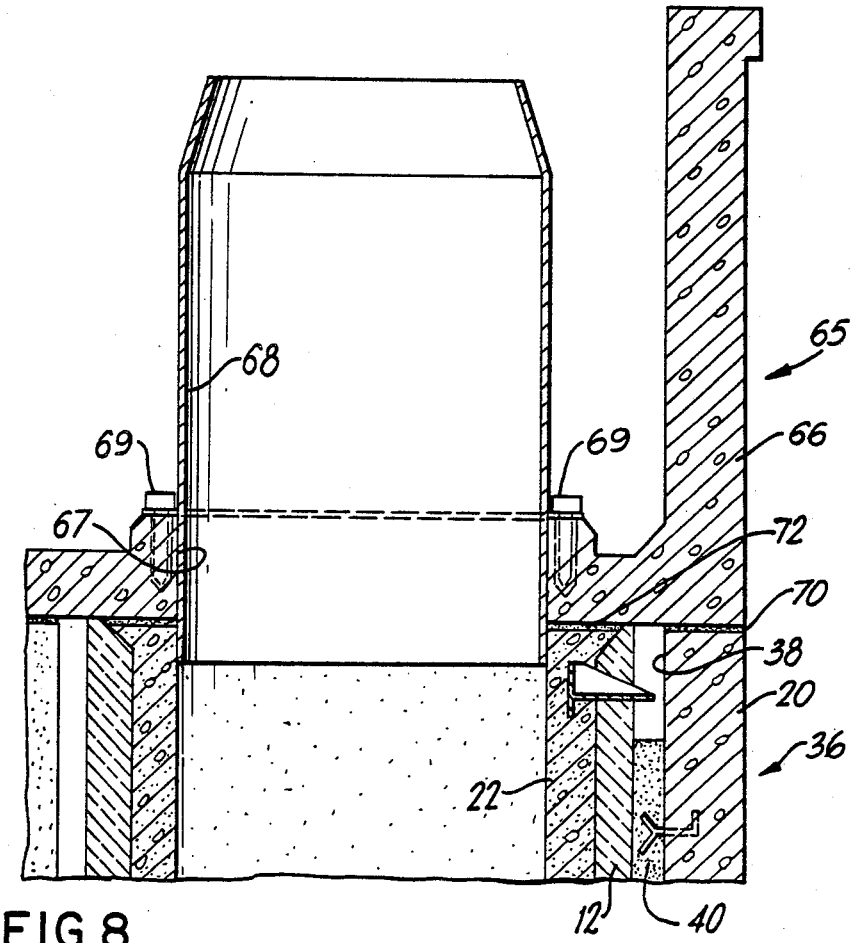
FIG. 8 is a partial elevational sectional view of the top of the smokestack along line G—G in FIG. 1.

A cap piece 65 is mounted at the top of the smokestack 10 is shown in FIG. 8. The cap piece 65 has an outer wall extension 66 which has an outer periphery section which extends upwardly from the concrete body 20 of the top section 36. A flue exit 68, preferably constructed of steel, is mounted in an aperture 67 of cap piece 65. The flue exit 68 is preferably mounted to cap piece 65 with conventional wedge anchors 69 positioned in cap piece 65 around the periphery of flue exit 68. The aperture 67 in outer wall extension 66 is sized to have the same diameter as the flue diameter inside the inner flue liner 22 of section 36. The flue exit 68 is mounted in aperture 67 such that it extends downwardly into the flue of inner liner 22. The flue exit 68 has a tapered top to increase the velocity of the hot gases as they exit the smokestack to obtain greater plume rise. The outer wall extension 66 is cemented to the concrete body 20 of section 36 with morter as at 70. The inner flue liner 22 of the section 36 located adjacent to the cap piece 65 must be cut off by the amount the inner liner 56 extends above the outer wall 54 of first section 12 as shown in FIG. 6. If the inner flue liner 22 is also constructed of precast concrete, the cap piece 65 is cemented to the inner flue liner 22 as at 72, as shown in FIG. 8.

The cap piece 65 of smokestack 10 may be provided with a drain hole (not shown) to collect rainwater and other moisture accumulation at the top of the stack and direct this moisture to a drain pipe 78 as shown in FIG. 2. The drain pipe 78 is positioned in an aperture 80 formed in the concrete body 20, as shown in FIG. 2 and in a corresponding aperture in the bottom section 17 and cap piece 65. The drain pipe 78 leads to a drain collector 82 formed in the base 15, as shown in FIG. 6. An exit drain pipe 84 is embedded in base 15 when it is formed, as shown in FIG. 6. The exit drain pipe 84 transports the moisture from drain pipe 78 out of and away from the smokestack 10 as shown in FIG. 4. Although not shown, similar drain apparatus may be used at the bottom of each flue of the smokestack 10 to transport any moisture at the bottom of the flue out of and away from the smokestack 10.

Figure 9:
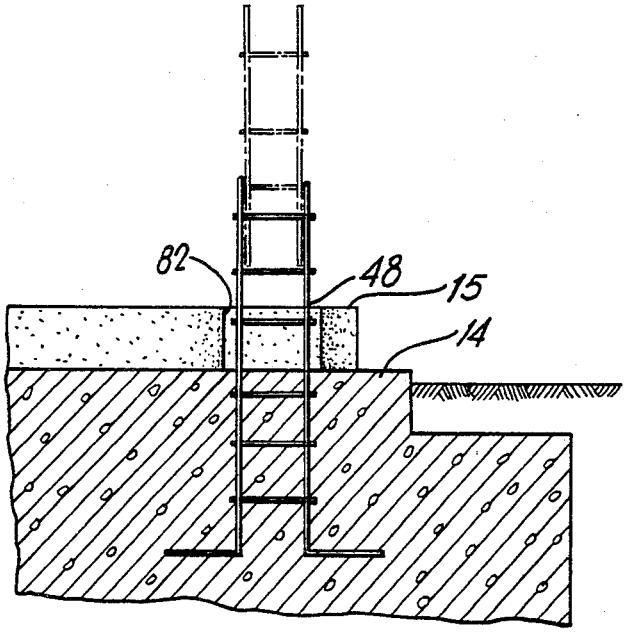
FIG. 9 is a partial elevational sectional view showing reinforcing bars embedded in the foundation according to the present invention.

In constructing this smokestack, a foundation is poured at the job site and reinforcing rods 48 are inserted in the concrete before the concrete hardens as shown in FIG. 9. These reinforcing rods extend upwardly from the top of the foundation sufficiently to be received by and extend through corresponding apertures 82 in the base 15 and aperture 46 as shown in FIG. 4 of the base section 37.

After the base 15 is placed on the foundation 14 and cemented thereto, the base section 37 is carried to the job site by lifting devices 52. The base section 37 is then cemented to base 15. Lifting devices 52 are then unthreaded from threaded sleeves 50. The next section 36 of the smokestack 10 is then carried to the job site in preassembled condition with lifting devices 52 and placed on the first section 37 already in place. The reinforcing rods 48 are threaded through apertures 46 of the section 36 being placed. If the reinforcing rods 48 are not of sufficient length to extend through the section 36, then additional lengths of reinforcing rods are welded or otherwise tied to the reinforcing rods already in place. While the section 36 is being lifted by a derrick or other means to its place in the smokestack 10, shims 72 are placed between the top of the concrete body of the section already in place and morter 74 is placed around the shims as shown in FIG. 3. The shims 72 hold the sections in spaced relation to prevent the morter from being squeezed out of the mating portions of adjacent sections during erection.

The top of the flue liner 56 of the base section 37 and flue liner 22 of each section 36 is provided with a step 86 as shown in FIG. 3 which steps downwardly and outwardly and which mates with a corresponding step 88 of the bottom of the flue liner 22 of each section which steps upwardly and inwardly. Preferably, asbestos 90 is placed in the space between the steps at the inward portion of the step as shown in FIG. 3. The asbestos 90 provides structure for preventing leakage of smokestack gases during operation if a crack should develop in the morter bonding adjacent sections. Next, morter is placed between the inner flue liner, if constructed of concrete, of the section 36 to be placed and the section already in place at the outer portion of the step as shown in FIG. 3. After the section 36 to be placed is positioned on the section already in place, the derrick is then disconnected from the lifting devices 52 and lifting devices 52 are unthreaded from threaded sleeves 50 in preparation for placement of the next section.

The flue liner 22 of the section 36 being placed on the section already in place is pushed upwardly by the extension of flue liner 56 of the base section 37. The support bracket 44 of each section which supports and carries the flue liner when the section is being transported and lifted is moved from a position resting on flue liner support 40, as shown in FIG. 3 (shown in phantom) to a position spaced from the flue liner support 40, as shown in solid in FIG. 3. With this construction, the inner flue liner is freestanding and is not supported by the outer concrete body portion of smokestack 10.

By having the sections preassembled and having structure for supporting the flue liner during transportation of the section the entire smokestack can be erected quickly and easily without complicated adjustments at the time of erection to insure that the joints between the flue liners of adjacent sections are staggered in relation to the joints between the outer walls of adjacent sections. Thus, with the present invention, a dual wall smokestack having freestanding inner and outer walls can be erected quickly and easily.

While the fundamental novel features of the invention have been shown and described, it should be understood that various substitutions, modifications and variations may be made by those skilled in the art without departing from the spirit or scope of the invention. Accordingly, all such modifications and variations are included in the scope of the invention as defined by the following claims.

I claim:

1. A smokestack having freestanding dual walls constructed of preassembled sections axially stacked one upon the other wherein a section comprises:

an outer wall having a flue aperture and an aperture in parallel relation to the axis of the flue aperture to be aligned with a corresponding aperture of an adjacent section in the smokestack for receiving reinforcing rods extending through multiple sections of the smokestack and for receiving poured concrete as the smokestack is being erected to tie outer walls of the sections together;

an inner flue liner spaced concentrically with the outer wall and within the flue aperture;

a flue liner support means mounted to the outer wall within the flue aperture;

the flue liner moveable independently of and axially with respect to the outer wall and having means for engaging the flue liner support means to prevent the flue liner from moving downwardly and out of the flue aperture.

2. The smokestack according to claim 1 wherein the outer wall is constructed of precast concrete.

3. The smokestack according to claim 1 further including insulation in the space between the flue liner and the outer wall.

4. The smokestack according to claim 1 wherein the flue liner is constructed of precast concrete.

5. The smokestack according to claim 1 wherein the flue liner support means includes a block and the means for engaging the flue liner support means includes a bracket mounted to the inner liner.

* * * * *